US006419515B1

(12) United States Patent
Okayasu

(10) Patent No.: US 6,419,515 B1
(45) Date of Patent: Jul. 16, 2002

(54) CONNECTOR

(75) Inventor: Yasushi Okayasu, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/678,307

(22) Filed: Oct. 3, 2000

(30) Foreign Application Priority Data

Oct. 6, 1999 (JP) ..... 11-285979

(51) Int. Cl.[7] ..... H01R 13/027
(52) U.S. Cl. ..... 439/358; 439/352; 439/595
(58) Field of Search ..... 439/358, 595, 439/350, 351, 352, 353, 354

(56) References Cited

U.S. PATENT DOCUMENTS 3,399,374 A * 8/1968 Pauza et al. ..... 439/358
4,431,244 A * 2/1984 Anhalt et al. ..... 339/91
5,378,168 A * 1/1995 Sumida ..... 439/358

FOREIGN PATENT DOCUMENTS

JP 8-296613 * 11/1996

* cited by examiner

*Primary Examiner*—Tho D. Ta
*Assistant Examiner*—Truc Nguyen
(74) *Attorney, Agent, or Firm*—Banner & Witcoff, Ltd.

(57) ABSTRACT

Male and female connector housings 10 and 20 are latched in a fitted state by a locking arm 40 engaging with a stopping member 16. An upper face of an operating member 44 at a posterior end of the locking arm 40 forms an inclined face 50, this face 50 being inclined gradually downwards towards the anterior. An anterior end of the inclined face 50 rises abruptly upwards, forming a counteracting wall 51. In the case where the two housings 10 and 20 are to be separated, a finger F presses the operating member 44, causing the locking arm 40 to incline and release the lock. The upper face of the operating member 44 is concave, with the contacting wall 51 at its anterior end. Consequently, the location for placing the finger F during the pressing operation is clearly defined, and the finger is prevented from sliding forwards during the pressing operation. As a result, the pressing operation of the operating member 44, that is, the lock-releasing operation, can be performed smoothly.

12 Claims, 5 Drawing Sheets

CONNECTOR

TECHNICAL FIELD

The present invention relates to an electrical connector latched in a fitted state by a locking arm.

BACKGROUND TO THE INVENTION

A conventional connector is shown in FIG. 11 of the specification. This type of connector is provided with a locking arm 3 on an upper face of a female housing 1, the locking arm 3 extending in an anterior-posterior direction, and being capable of being inclined in a see-saw shape with a fulcrum 2 serving as its centre. The fulcrum 2 is provided at an approximately central location relative to the lengthwise direction of the locking arm 3. A stopping hole 6 is formed in an anterior end thereof, this stopping hole 6 engaging with a stopping member 5 which protrudes from a corresponding male housing 4. An operating member 7, used for a releasing operation, is formed on a posterior end of the locking arm 3. The locking arm 3 rises over the stopping member 5 as the female housing I is fitted to the male housing 4. When the two housings 1 and 4 reach a correct fitted state, the locking arm returns to its original position and the stopping member 5 fits into the stopping hole 6. thereby latching the two housings 1 and 4 in the correct fitted state. From this state, when the operating member 7 is pressed by a finger, the locking arm 3 pivots in a clockwise direction relative to FIG. 11, the stopping member 5 is removed from the stopping hole 6, and the lock is released.

However, in the conventional case, an upper face of the operating member 7 is approximately flat and protrudes only slightly to the posterior. Consequently, it is difficult to ascertain which location needs to be pressed with a finger, and the finger can easily slide forwards after it has pressed the operating member 7. As a result, the pressing operation of the operating member 7, that is, the lock-releasing operation, may be difficult.

The present invention has taken the above problem into consideration, and aims to present a connector wherein the lock-releasing pressing operation of a locking arm is simpler.

SUMMARY OF THE INVENTION

According to the invention, there is provided an electrical connector comprising a pair of connector housings adapted for mutual fitting in a fitting direction, one of said housings having a resilient pivotable locking arm, and the other of said housings having a locking member engageable by one end of said locking arm, and the other end of said locking arm comprising an operating member adapted for pressing by a finger to release said locking arm and locking member, said operating member having an abutment to prevent a finger moving toward said one end in use.

The locking arm may include a recess adapted to receive a finger, and the abutment preferably forms the end of this recess. The operating member is preferably widened and stepped into said recess to improve operability.

In the preferred embodiment the locking arm has a fulcrum at the mid point, and the abutment is coincident with this fulcrum. Stiffening ribs may be provided on the underside of the operating member.

BRIEF DESCRIPTION OF DRAWINGS

Other features of the invention will be apparent from the following description of a preferred embodiment shown by way of example only in the accompanying drawings in which.

DESCRIPTION OF PREFERRED EMBODIMENT

An embodiment of the present invention is described below with the aid of FIGS. 1 to 10.

Figure 1:
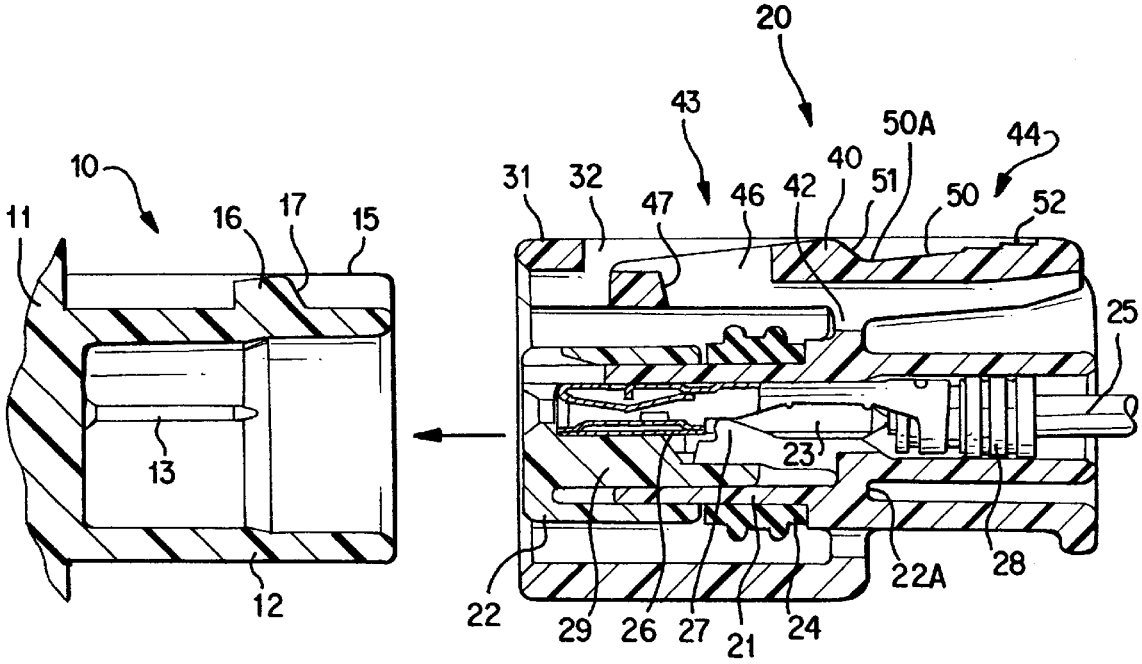
FIG. 1 is a vertical cross-sectional view of an embodiment of the present invention showing male and female housings prior to being fitted together.

As shown in FIG. 1 a waterproof connector comprises a male connector housing 10 and a female connector housing 20, these male and female housings 10 and 20 fitting mutually together. Hereafter, fitting sides of the male and female housings 10 and 20 are designated as the anterior.

The male housing 10 is made from plastic and is formed in a unified manner with another component 11. The male housing 10 has a rectangular small hood 12 protruding in an anterior direction. A plurality of terminal fittings 13 protrude from an innermost wall of the small hood 12, these terminal fittings 13 being tab-shaped and being horizontally aligned with specified spaces therebetween.

Figure 2:
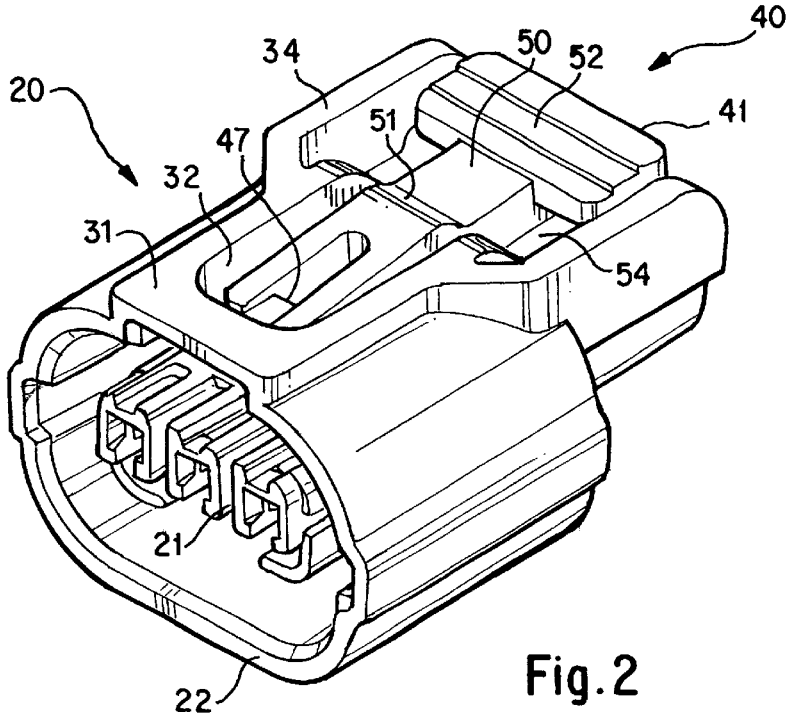
FIG. 2 is a diagonal view of the female housing.
Figure 3:
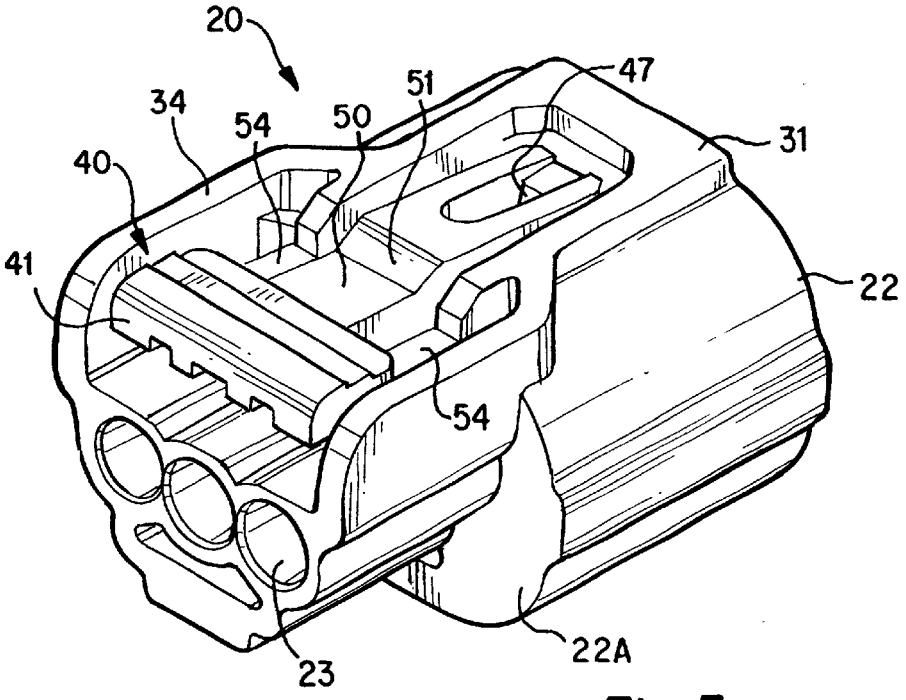
FIG. 3 is a diagonal view of the female housing seen from its rear face.

The female housing 20 is also made from plastic and is provided with a terminal housing 21, this terminal housing 21 fitting within the small hood 12 and having a prescribed clearance therewith. As shown in FIG. 2, a large hood 22 is formed around an anterior half of the terminal housing 21, this large hood 22 fitting tightly with outer sides of the small hood 12.

The terminal housing 21 of the female housing 20 is provided with cavities 23 which house female terminal fittings 26. These cavities 23 correspond in number with the number of male terminal fittings 13 of the male housing 10. A sealing ring 24 made from resilient material such as rubber or the like is attached to the circumference of the terminal housing 21 at a location immediately to the anterior of the innermost wall 22A of the large hood 22. This sealing ring 24 is resiliently compressed between an outer circumference of the terminal housing 21 and an inner circumference of an anterior end of the small hood 12, thereby forming a seal between the two housings 10 and 20.

The female terminal fittings 26 which have ends of electric wires 25 fixed thereto are inserted from the posterior into the cavities 23 and are retained by lances 27 provided on base faces of these cavities 23. Waterproof rubber stoppers 28 cover the rear entrances of the cavities 23, and then a front retainer 29 is attached, thereby doubly retaining the female terminal fittings 26 and preventing the removal of the sealing ring 24.

Next, a locking mechanism for locking the male housing 10 and the female housing 20 in a correct fitting position will be explained.

A parallel pair of guiding walls 15 are formed on an upper face of the small hood 12 of the male housing 10, these guiding walls 15 being provided at a central location relative to the width-wise direction and facing an anterior-posterior direction. A stopping member 16 protrudes at a location between and slightly to the anterior of the two guiding walls 15, an anterior face of this stopping member 15 being inclined sharply to form a tapered face 17.

Figure 4:
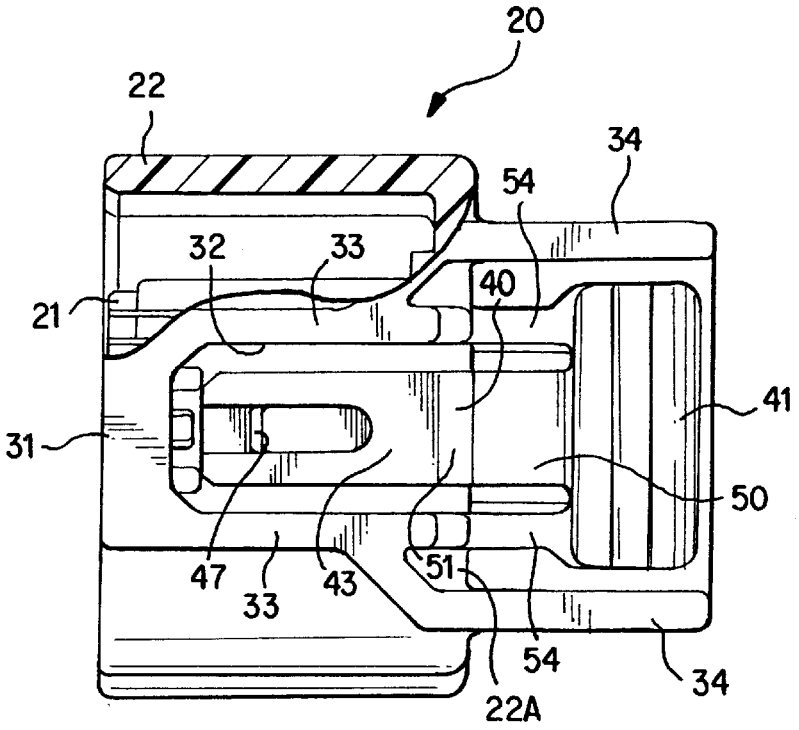
FIG. 4 is a partially cut away plan view of the female housing.
Figure 5:
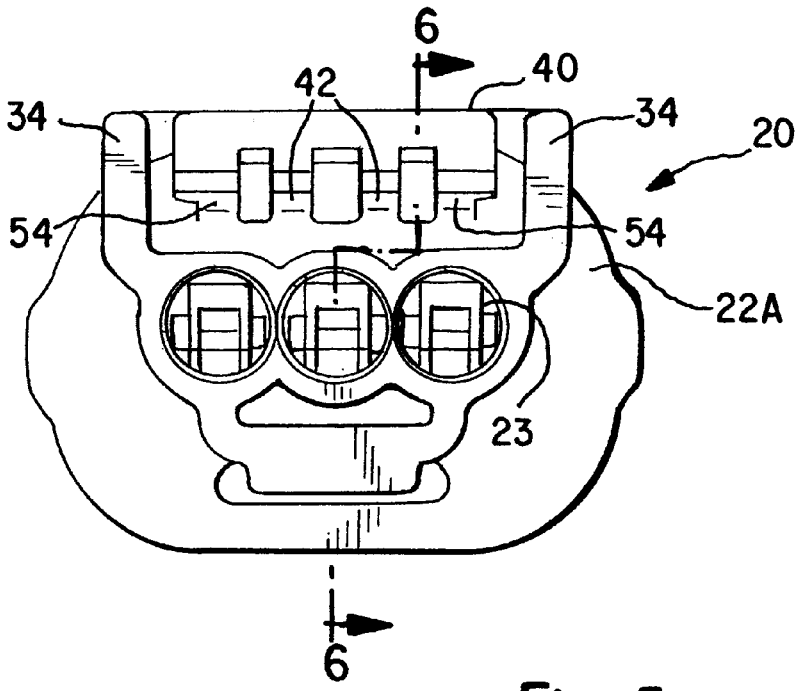
FIG. 5 is a rear face view of the female housing.

A locking arm 40 is formed on an upper face of the female housing 20. A protruding member 31 is formed on an upper face of the large hood 22, at a central location in a width-wise direction thereof. A recess 32 is formed in an upper face of this protruding member 31, this recess 32 being formed at a location slightly inwards from an anterior edge of the upper face of the protruding member 31 and extending to a posterior edge thereof, the recess 32 being open at this posterior edge. As shown in FIG. 4, left and right side walls 33 of this recess 32 become wider part-way along their length and extend towards a posterior edge of the upper face of the terminal housing 21. These form a pair of retaining walls 34. This pair of retaining walls 34 has the same height as the upper face of the protruding member 31 and forms a unified face therewith.

The locking arm 40 is provided in the space between the recess 32 and the two retaining walls 34. As shown in FIG. 4, the locking arm 40 forms a T-shape when seen from above, is thin and narrow in the anterior-posterior direction and has a wide-width member 41 at its posterior end. Two side edges of a lower face of the locking arm 40 join with the upper face of the terminal housing 21 at an approximately central location in a length-wise direction along this locking arm 40. these two joining portions forming a fulcrum 42. The locking arm 40 is capable of being inclined in a see-saw manner. The location of the fulcrum 42 is approximately identical with the location of the innermost wall 22A of the large hood 22.

The locking arm 40 has a locking member 43 at its anterior side and an operating member 44 at its posterior side, this operating member 44 allowing the releasing operation to be performed. The fulcrum 42 is located between the locking member 43 and the operating member 44. As shown in FIG. 1, an upper face of the locking member 43 inclines slightly downwards from the location of the fulcrum 42 towards the anterior end, this locking member 43 being capable of advancing in a straight line between the two guiding walls 15 of the male housing 10. A groove 46 is formed in the locking member 43 from a location slightly inwards from the anterior end of the locking member 43, this groove 46 extending towards the posterior. An anterior end of this groove 46 forms a stopped face 47 which is capable of engaging with the stopping member 16 of the male housing 10.

An upper face of the operating member 44 forms an inclined face 50, this inclined face 50 being inclined gently downwards towards an anterior from the wide-width member 41 at the posterior end, towards the location of the fulcrum 42. An anterior end of the inclined face 50 rises abruptly upwards towards the top of the locking member 43, this anterior end forming an abutment or a contacting wall 51. A catching face 52 is formed on an upper face of the wide-width member 41, this catching face 52 having a stepped shape which rises sharply upwards towards the posterior.

Figure 6:
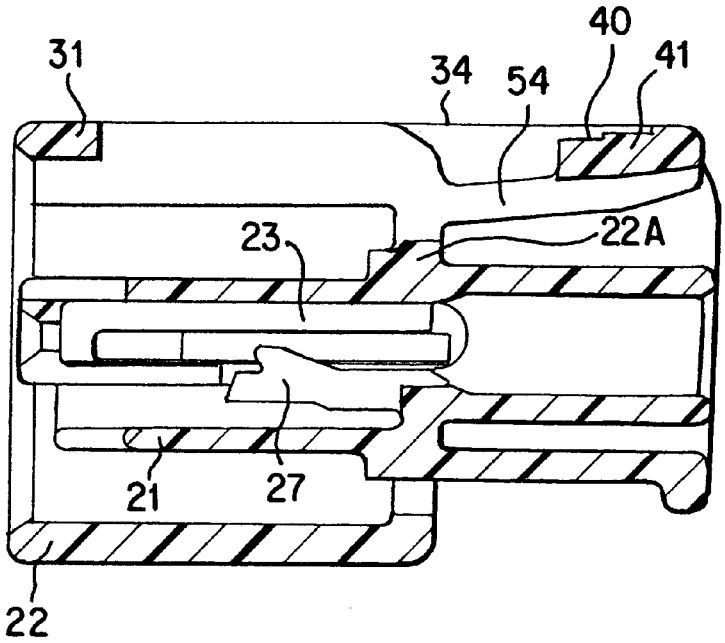
FIG. 6 is a cross-sectional view of FIG. 5 along the line X—X.
Figure 7:
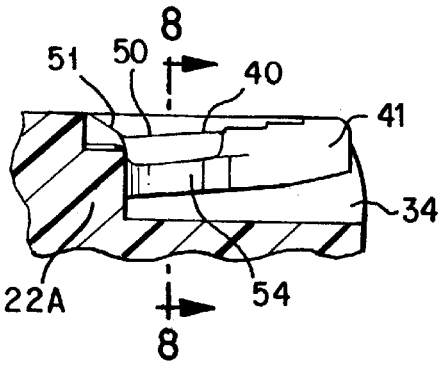
FIG. 7 is a partial cross-sectional view showing the positional configuration of strengthening members.
Figure 8:
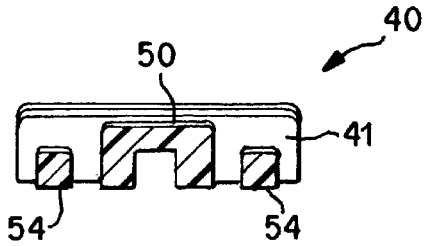
FIG. 8 is a cross-sectional view of FIG. 7 along the line Y—Y.

As shown in FIGS. 4 and 6, a pair of strengthening members 54 extend between lower portions of anterior face walls of the left and right protruding portions of the width member 41 and an inner face (opposing the aforementioned portions) of the innermost wall 22A of the large hood 22. These strengthening members 54 strengthen the fulcrum 42 of the locking member 40. The strengthening members 54 are located below a base 50A of the inclined face 50 of the operating member 44.

Next, the operation of the present embodiment will be explained. As described earlier, the female terminal fittings 26, which have the ends of the electric wires 25 fixed thereto, are pushed from the posterior into the cavities 23 of the female housing 20 and are housed therein in a doubly retained state by the retainer 29.

Figure 9:
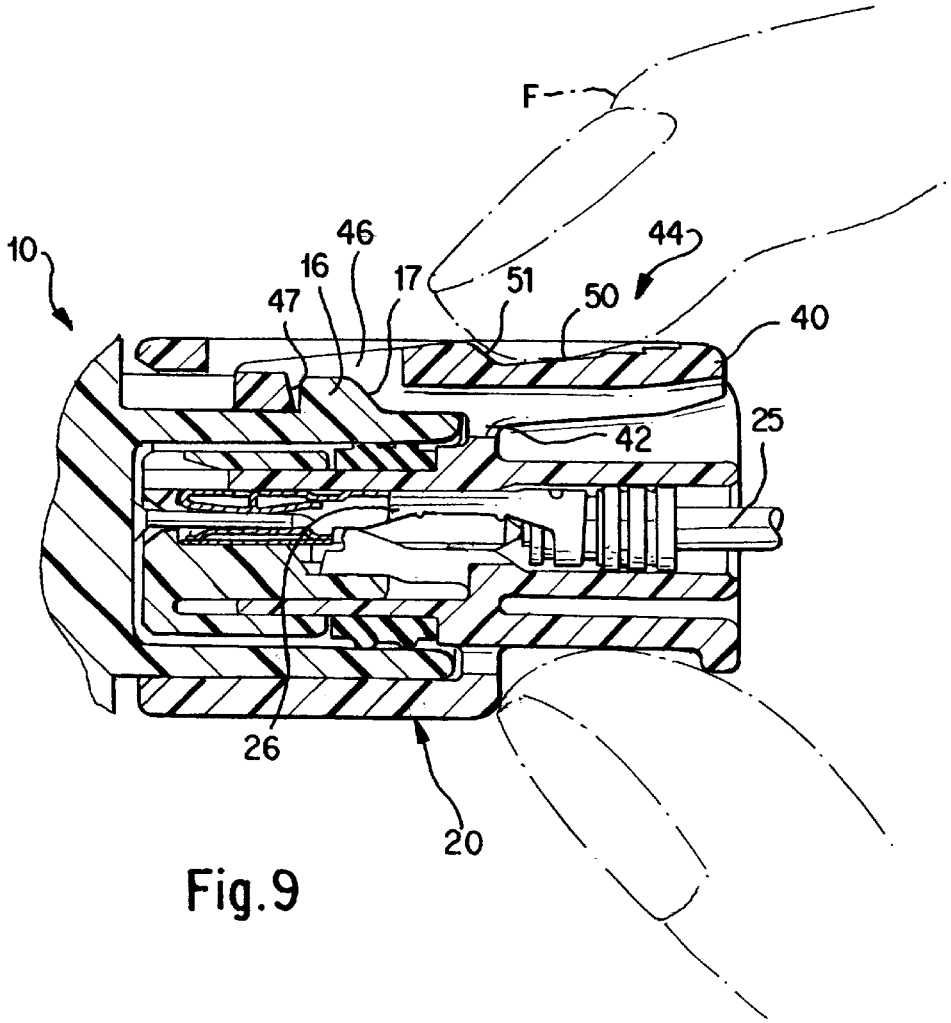
FIG. 9 is a vertical cross-sectional view showing the two housings after fitting has been completed.

From this state, as shown by the arrow in FIG. 1, the female housing 20 is fitted to the male housing 10. As this fitting progresses, the anterior end of the locking member 43 of the locking arm 40 makes contact with the tapered face 17 of the stopping member 16 of the male housing 10, and the anterior end of the locking arm 40 is pushed so as to incline upwards and pass over the stopping member 16. When the female housing 20 is pushed in to a specified position, the stopped face 47 of the locking arm 40 passes beyond the location of the stopping member 16. Consequently, as shown in FIG. 9, when the locking arm 40 returns to its original position, the stopping member 16 fits within the groove 46, the stopped face 47 engages, and the two housings 10 and 20 are locked in the fitted state.

Figure 10:
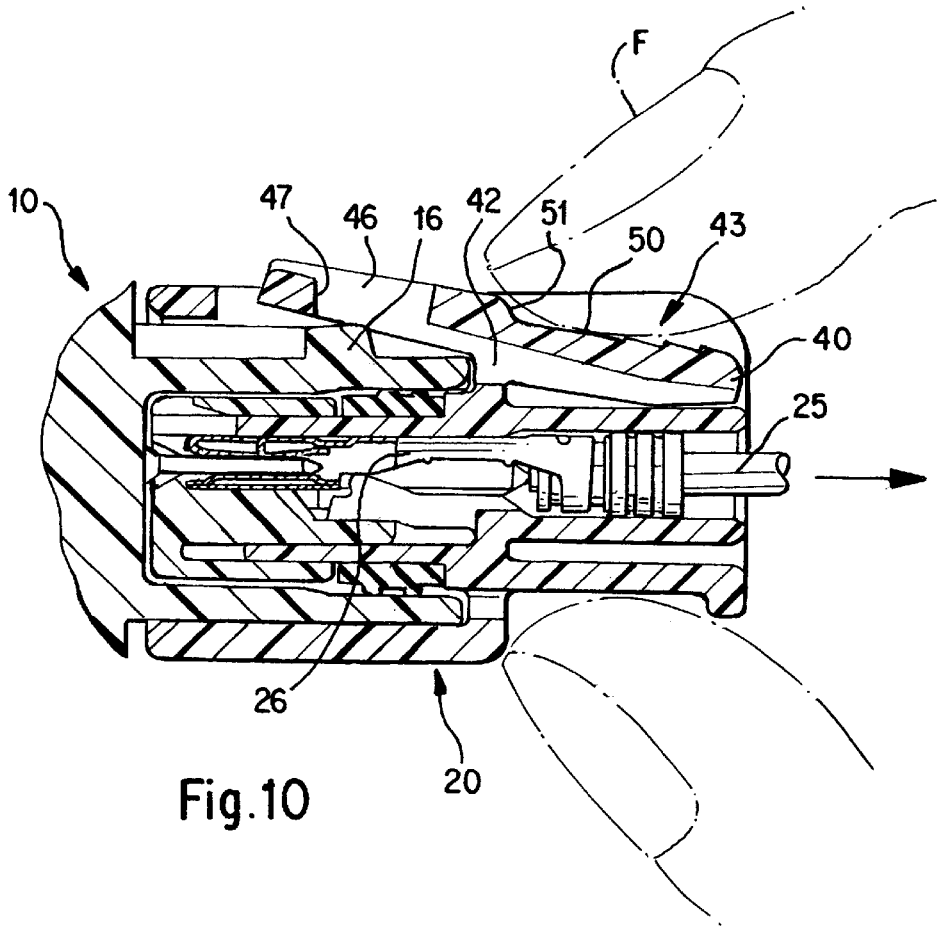
FIG. 10 is a vertical cross-sectional view showing a separating operation.
Figure 11:
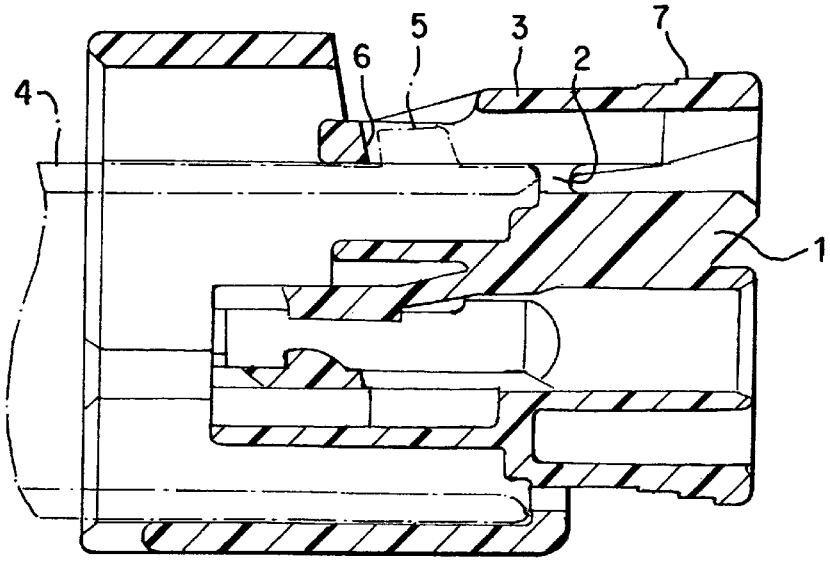
Fig.11 PRIOR ART
FIG. 11 is a vertical cross-sectional view of a prior art example.

The male and female housings 10 and 20 can be separated, for maintenance or the like, in the following manner. As shown by the chain line in FIG. 9, the posterior end of the female housing 20 is gripped, with a finger F being placed on the inclined face 50 of the operating member 44 of the locking arm 40, and the operating member 44 is pressed downwards. then, as shown in FIG. 10, the anterior end of the operating member 44 rises upwards, with the fulcrum 42 as its centre, the stopping member 16 is separated from the lower portion of the stopped face 47, and the lock is released. Next, the female housing 20 is pulled in a posterior direction, thereby separating it from the male housing 10.

The upper face of the operating member 44 of the locking arm 40 is provided with the inclined face 50 which has the contacting wall 51 at its anterior end. Consequently, the location in which the finger F should be placed to perform the pressing operation is clearly defined, and the finger F is prevented from sliding forwards as the pressing operation is performed. As a result, the pressing operation of the operating member 44, that is, the locking-releasing operation, can be performed smoothly.

Furthermore, the strengthening members 54 are provided to prevent permanent set-in fatigue in the fulcrum 42. The strengthening members 54 are located lower than the base 50A of the inclined face 50 of the operating member 44. Consequently, these strengthening members 54 to not interfere with the position of the finger F when the pressing operation is to be performed.

Furthermore, the present invention is not limited to the embodiment described above with the aid of figures. For example, the possibilities described below also lie within the technical range of the present invention. In addition, the present invention may be embodied in various other ways without deviating from the scope thereof.

(1) Rather than having the upper face of the operating member of a locking lever approximately flat, as was previously the case, the present invention also encompasses the case whereby the contacting wall rises at a location in the vicinity of the fulcrum, this case still allowing the finger to be positioned and preventing the finger from sliding forwards.

(2) The present invention is equally suitable for a connector wherein the locking arm the locking member engaging therewith are provided on the male and female housings respectively, instead of the female and male housings as in the present embodiment.

I claim:

1. An electrical connector comprising a pair of connector housings adapted for mutual fitting in a fitting direction, one of said housings having a resilient locking arm pivotable about a fulcrum and at least one stiffening member, and the other of said housings having a locking member engageable by one end of said locking arm, and the other end of said locking comprising an operating member, the operating member being adapted for pressing by a finger to release said locking arm and locking member, said operating member having an abutment to prevent a finger moving toward said one end in use, and each of said stiffening member extending from the operating member to said one of said housings, wherein a gap extends between each of said stiffening member and the locking arm.

2. A connector according to claim 1 wherein said abutment comprises one end of said recess.

3. A connector according to claim 1 wherein said fulcrum is at substantially a mid-part of said locking arm, said abutment being approximately coincident with said fulcrum.

4. A connector according to claim 1 wherein said one end of said locking arm has an under surface parallel to said fitting direction and an opposite surface at an angle to said fitting direction, said one end being thinner at a tip thereof.

5. A connector according to claim 1 wherein said other end of said locking arm is widened at a tip thereof in a direction perpendicular to said fitting direction.

6. A connector according to claim 2 wherein said operating member is stepped in a direction parallel to said fitting direction.

7. A connector according to claim 2 wherein said operating member is substantially planar, one or more stiffening members being located on the opposite side to said recess, and extending along said locking arm.

8. A connector according to claim 6 wherein the steps of said operating member descend to said recess.

9. A connector according to claim 7 wherein said stiffening member comprises two parallel ribs.

10. A connector according to claim 9 wherein said ribs extend to a fulcrum of said locking arm.

11. A connector according to claim 7 wherein said fulcrum is at substantially a mid-part of said locking arm, said abutment being approximately coincident with said fulcrum.

12. An electrical connector comprising a pair of connector housings adapted for mutual fitting in a fitting direction, one of said housings having a resilient locking arm pivotable about a fulcrum, and the other of said housings having a locking member engageable by one end of said locking arm, and the other end of said locking arm comprising an operating member, the operating member being adapted for pressing by a finger to release said locking arm and locking member, and at least one stiffening member, each stiffening member extending from the operating member to said one of said housings, wherein a gap extends between each stiffening member and the locking arm.

* * * * *